US005277167A

United States Patent [19]

DeLand et al.

[11] Patent Number: 5,277,167

[45] Date of Patent: Jan. 11, 1994

[54] VAPOR MANAGEMENT VALVE

[75] Inventors: Daniel L. DeLand, Davison; Charles A. Detweiler, Durand; Gerrit V. Beneker, Fair Haven, all of Mich.

[73] Assignee: Lectron Products, Inc., Rochester Hills, Mich.

[21] Appl. No.: 13,750

[22] Filed: Feb. 4, 1993

[51] Int. Cl.[5] ..... F02M 33/02

[52] U.S. Cl. ..... 123/518; 123/520

[58] Field of Search ..... 123/516, 518, 520, 521; 251/118

[56] References Cited

U.S. PATENT DOCUMENTS

| | | | |
|---|---|---|---|
| 4,522,371 | 6/1985 | Fox et al. | 251/139 |
| 4,534,375 | 8/1985 | Fox | 137/82 |
| 4,715,396 | 12/1987 | Fox | 137/82 |
| 4,951,637 | 8/1990 | Cook | 123/520 |
| 4,995,369 | 2/1991 | Cook | 123/520 |
| 5,050,568 | 9/1991 | Cook | 123/521 |
| 5,054,455 | 10/1991 | Cook | 123/520 |
| 5,069,188 | 12/1991 | Cook | 123/520 |
| 5,083,546 | 1/1992 | Detweiler | 123/520 |
| 5,113,837 | 5/1992 | Faull | 251/118 |
| 5,115,785 | 5/1992 | Cook | 123/520 |
| 5,183,022 | 2/1993 | Cook | 123/520 |

*Primary Examiner*—E. Rollins Cross
*Assistant Examiner*—Thomas N. Moulis
*Attorney, Agent, or Firm*—Harness, Dickey & Pierce

[57] ABSTRACT

A flow regulator for automotive vehicles of the type having a computer-controlled emission control system. The flow regulator has an electric vacuum regulator (EVR) valve that regulates the vacuum signal provided to a vacuum regulator valve in accordance with the current signal supplied to the EVR valve by the engine controller unit. The vacuum regulator valve includes a control chamber and a valve chamber that are separated by a movable diaphragm valve assembly. The preload on a biasing spring acting on the diaphragm valve assembly can be adjusted during calibration of the flow regulator for setting a first calibration point. An adjustable flow restrictor provided in the inlet portion of the vacuum regulator valve can be varied during calibration for setting a second calibration point. In operation, the flow regulator is operable to generate substantially linear output flow characteristic between the two calibration points as a function of the current signal in a manner that is independent of changes in manifold vacuum.

25 Claims, 3 Drawing Sheets

VAPOR MANAGEMENT VALVE

BACKGROUND OF THE INVENTION

The present invention relates generally to electronically-controlled flow regulators of the type used in automotive vehicles equipped with computer-controlled emission control systems.

As is known, virtually all modern automotive vehicles are equipped with emission control systems that are operable for limiting the emission of hydrocarbons into the atmosphere. Such emission control systems typically include an evaporative emission control system which traps fuel vapors from the fuel tank in a carbon-filled canister and a purge system which draws the vapors from the canister into the engine intake system. In this manner, fuel vapors from the fuel tank are delivered to the engine for subsequent combustion.

Conventional evaporative emission control systems are equipped with electronically controlled purge valves for regulating the flow rate of fuel vapors introduced into the intake system in response to specific engine operating parameters. Conventional purge valves comprise pulse width modulated (PWM) solenoid valves which are responsive to a duty cycle control signal from the engine computer. However, PWM purge valves provide uneven flow characteristics, particularly at low engine speeds, and also do not provide consistent flow control independent of variations in manifold vacuum.

In view of increasingly stringent emission regulations, the demands on the evaporative emission control system have increased dramatically. In particular, in order to satisfy current EPA emission requirements, the flow capability of the evaporative emission system must be increased. To achieve this result within the EPA city test cycle, it is therefore necessary to provide purge flow at engine idle speeds. Moreover, purge flow control must also be accurately regulated so as not to cause unacceptable excursions in overall engine output emissions.

To provide such enhanced flow control, it is desirable to have the output flow characteristics of the purge valve be proportional to the duty cycle of the electric control signal applied to the valve, even at low engine speeds, and yet be independent of variations in the manifold vacuum. Accordingly, the output flow of the valve should be substantially constant at a given duty cycle control signal and be controllable in response to regulated changes in the duty cycle regardless of variations in manifold vacuum. Moreover, it is also desirable that the output flow of the valve vary substantially linearly from a predetermined "minimum" flow rate at a "start-to-open" duty cycle to a specified "maximum" flow rate at 100% duty cycle.

The above performance demands have prompted the recent development of a purge flow regulator that combines an electric vacuum regulator (EVR) solenoid valve with a diaphragm-type vacuum regulator valve to provide the desired continuous controlled flow characteristics independent of variations in manifold vacuum. In particular, the EVR solenoid valve is connected to the diaphragm vacuum regulator valve so as to regulate the vacuum signal supplied to the reference side of the diaphragm valve in accordance with the control signal from the engine computer.

A closure member, associated with the opposite side of the diaphragm, controls flow from the input port to the output port of the vacuum regulator valve in response to regulated movement of the diaphragm. Since the EVR valve is in communication with atmosphere and a vacuum source, such as the intake manifold of the engine, the amount of vacuum (i.e., the vacuum signal) provided to the reference side of the diaphragm is proportional to the electric control signal supplied to the EVR valve by the on-board engine control computer. Thus, output flow through the vacuum regulator valve is controlled by the duty cycle of the control signal applied to the EVR valve.

Examples of electronically controlled flow purge regulators of this type are disclosed in U.S. Pat. No. 4,534,378 to Cook and U.S. Pat. No. 5,050,568 to Fox. However, for such conventional flow regulators to satisfy the above-described performance specifications, the purge flow regulator must be precisely calibrated. It has been proposed to calibrate the purge flow regulator by adjusting the characteristics of the EVR solenoid valve. In particular, the preload on the armature bias spring of the EVR valve is adjusted for setting the minimum flow rate at the "start-to-open" duty cycle. Such changes in the magnitude of preload on the armature bias spring effectively displaces the performance curve without changing its slope. In addition, the reluctance of the solenoid flux path is adjusted for setting the maximum flow rate at the 100% duty cycle. However, changes in reluctance result in a corresponding change in the slope of the performance curve. As can be appreciated, this calibration approach is problematic in that each adjustment affects the other, such that the two calibration adjustments are dependent and cumulative in nature. As such, it typically requires several iterations to "zero-in" on both of the desired calibration points. Accordingly, while such conventional flow regulators are generally successful in automotive emission control systems for their intended purpose, there is a continuing need to develop alternatives which meet the above-noted performance specifications and can be manufactured and calibrated in a more efficient and cost effective manner.

SUMMARY OF THE INVENTION

Accordingly, it is a primary object of the present invention to overcome the disadvantages of the prior art and provide an improved electronically-controlled flow regulator that is less costly to manufacture and which eliminates the need for EVR valve calibration. As a related object, the vapor management valve of the present invention combines an EVR valve and a vacuum regulator valve for generating an output flow characteristic that is proportional to the duty cycle of the electric control signal and which is independent of variations in the manifold vacuum.

Another object of the present invention is to provide the above-noted vapor management valve with means for independently setting the calibration points without cumulatively effecting any previous calibration adjustments. More particularly, means are provided for adjusting the preload of a biasing spring acting on the reference side of the vacuum regulator valve for adjusting the vacuum differential to match the vacuum output of the EVR valve at the specified "start-to-open" duty cycle. In addition, means are also provided for adjusting a parallel flow path associated with the input side of the vacuum regulator valve for setting the maximum flow rate at 100% duty cycle. By calibrating the start-to-open point first, subsequent calibration of the maximum flow rate at 100% duty cycle will not effect the start-to-open point calibration. In this manner, the requirement of calibrating the EVR valve magnetics and/or the preload on the armature biasing spring can be eliminated. Thus, the present invention discloses an improved electronically-controlled flow regulator that can accommodate a "net build" EVR valve and which can be economically manufactured and simply calibrated to produce superior performance characteristics.

Additional objects and advantages of the present invention will become apparent from a reading of the following detailed descriptions of the preferred embodiments taken in conjunction with the accompanying drawings and appended claims.

DESCRIPTION OF THE PREFERRED EMBODIMENTS

Figure 1:
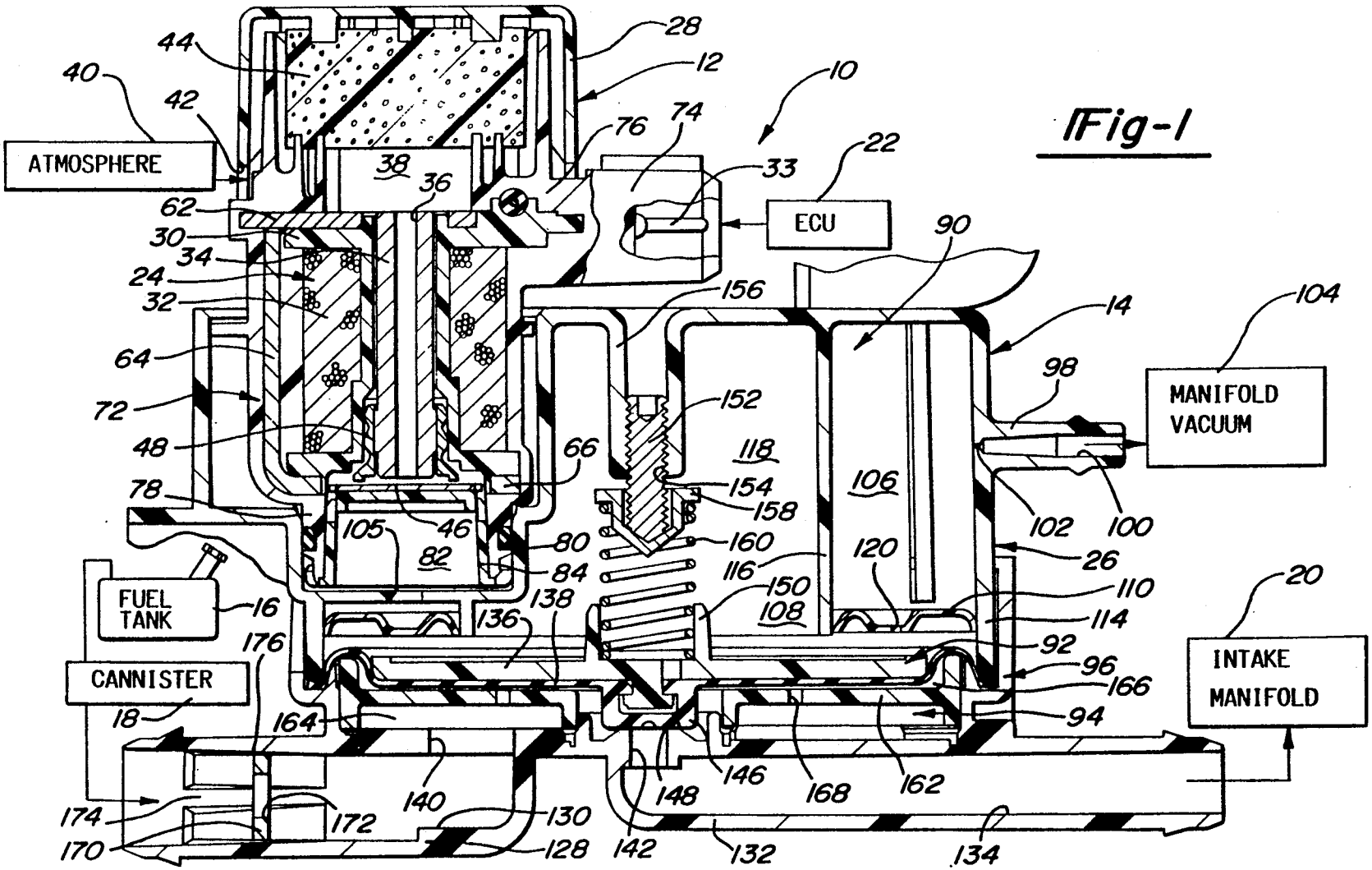
FIG. 1 is a sectional view of an electronically-controlled flow regulator shown diagrammatically associated with an evaporative emissions control system according to a preferred embodiment of the present invention.

In general, the present invention is directed to improvements in proportional valves of the type used in automotive vehicles for controlling various fluid-operated systems. More particularly, a preferred embodiment of an electronically-controlled flow regulator is disclosed which is adapted for use in an evaporative emission control system for purging fuel vapors collected in a charcoal canister into the intake system of the vehicle's internal combustion engine. However, it will be readily appreciated that the improved flow regulator of the present invention has utility in other vehicular flow controlling applications.

In the drawings, wherein for purposes of illustration is shown a preferred embodiment of the present invention, an electronically-controlled flow regulator 10 is disclosed as having an electrically-actuated vacuum regulator ("EVR") valve 12 and a vacuum regulator valve 14. By way of example, flow regulator 10 is shown as a vapor management valve of the type associated with a conventional evaporative emission control system for an automotive vehicle. More specifically, fuel vapors vented from a fuel tank 16 are collected in a charcoal canister 18 and are controllably purged by vapor management valve 10 into the intake system 20 (i.e., the intake manifold) of the vehicle's internal combustion engine in response to electrical control signals supplied to EVR valve 12 by a remote engine controller unit ("ECU") 22. As will be discussed hereinafter in greater detail, the novel structure of vapor management valve 10 permits use of a "net-build" non-calibrated EVR valve 12 in association with a vacuum regulator valve 14 that can be simply and precisely calibrated to meet the desired output flow characteristics. Furthermore, while EVR valve 12 and vacuum regulator 14 are shown assembled as a unitary flow regulator 10, it is to be understood that the valves could be separate components that are interconnected by suitable tube connections in a known manner.

Figure 2:
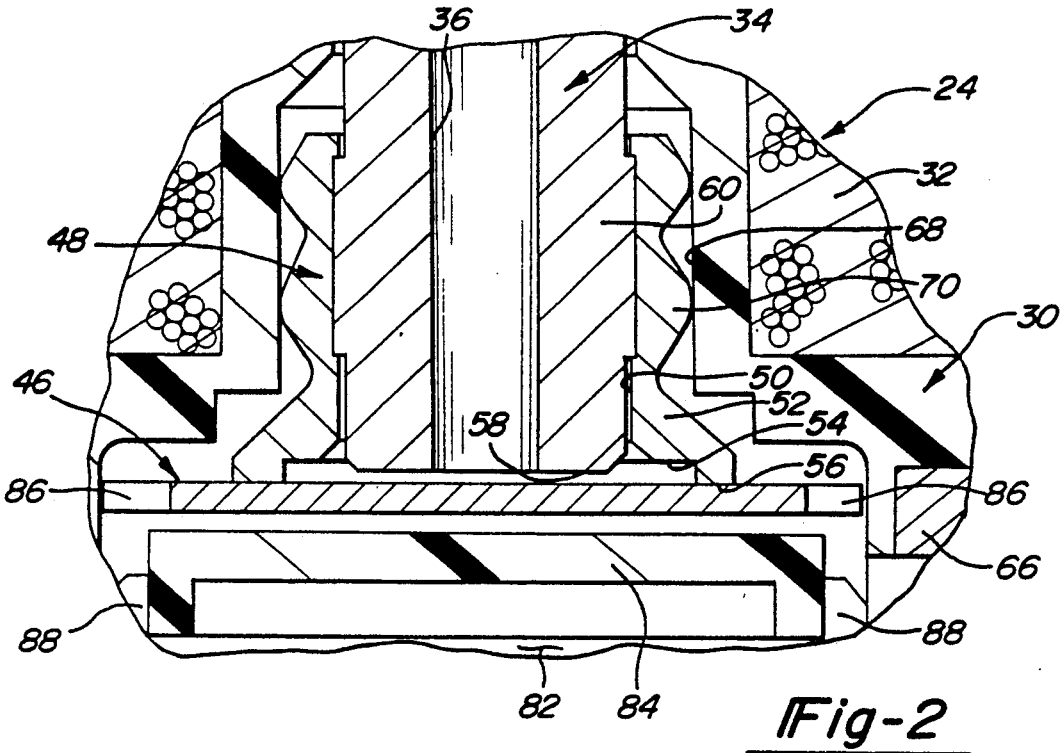
FIG. 2 is an enlarged sectional view of a portion of the EVR valve associated with the flow regulator of FIG. 1.

As best seen from FIGS. 1 and 2, EVR valve 12 is an encapsulated solenoid assembly 24 secured to an upper valve housing 26 of vacuum regulator valve 14 having a filter cover 28 removably connected to a top portion thereof. Solenoid assembly 24 includes a bobbin 30, fabricated from a nonmagnetic nylon-type material, having a plurality of coil windings 32 wound thereon. The ends of coil winding 32 are electrically connected to a pair of terminal blades 33. A magnetic pole piece 34 extends through a hollow central core of bobbin 30 and, in turn, has a central bore 36 formed therein which serves as an air passageway which communicates with an air inlet 38. Atmospheric air, identified by block 40, is admitted into air inlet 38 through a plurality of apertures 42 formed in filter cover 28 and is filtered by a permeable filter 44 located inside filter cover 28. The discharge of atmospheric air from the bottom of central bore 36 in pole piece 34 is controlled by a flat disc-type magnetic armature 46 which is adapted to seat against a nonmagnetic valve seat member 48 that is fixed to a lower end of pole piece 34. In the preferred embodiment, valve seat member 48 is made of brass, and has a central bore 50 formed therein having a diameter substantially equal to the outside diameter of pole piece 34. The lower portion of valve seat member 48 has a radially enlarged annular flange 52 which accommodates a shallow counterbore 54 formed in a bottom face 56 of valve seat member 48. The resulting annular-shaped bottom face 56 defines a valve seat and is preferably machined with a slight radial back taper to provide a circular "line" seal with flat disc armature 46.

During assembly, valve seat member 48 is installed on the lower end of pole piece 34 in a fixture that automatically sets the axial position of valve seat surface 56 relative to an end face 58 of pole piece 34. More specifically, when pole piece 34 is inserted into bore 50, a slightly oversized knurled region 60 of pole piece 34 embeds in the inner wall of valve seat bore 50 to create a tight frictional engagement between the two components. This is important since the axial distance between end face 58 of pole piece 34 and seat surface 56 of valve seat member 48 defines the primary or working air gap between pole piece 34 and armature 46 in the "closed" valve position (FIG. 2) when EVR valve 12 is fully assembled. In this manner, the primary air gap of EVR valve 12 remains constant from unit to unit to provide a "net-build" valve assembly.

Surrounding the top end of pole piece 34 is an annular-shaped magnetic flux collector ring 62 that is connected to a magnetic L-frame member 64. L-frame member 64 includes an annular-shaped lower segment 66 that surrounds armature 46. Thus, when solenoid assembly 24 is energized by current flow through coil windings 32, the magnetic flux path is defined by pole piece 34, armature 46, L-frame member 64, and flux collector ring 62. The combined pole piece 34 and valve seat member 48 subassembly is shown inserted into an enlarged bore section 68 (FIG. 2) of bobbin 30 until the top end of pole piece 34 is substantially flush with the top surface of flux collector ring 62. To frictionally bond valve seat member 48 within bore section 68 of bobbin 30, ridge-like barbs 70 formed on the outer wall surface of valve member 48 embed or "bite" into the inner wall surface of bore 68 to resist withdrawal therefrom. In addition, the tight seal formed between bobbin 30 and valve seat member 48 serves to inhibit leakage of atmospheric air from air inlet 38 around the outside of seat member 48.

Flux collector ring 62 is installed on the top of bobbin 30 and L-frame member 64 is installed with lower segment 66 thereof placed over the bottom of bobbin 30. L-frame member 64 has a pair of depending tabs (not shown) which are adapted to mate with corresponding recesses formed on opposite sides of flux collector ring 62, for mechanically joining the two components. With the magnetic segments joined to wound bobbin 30, the entire sub-assembly is encapsulated in an injection mold which forms a housing 72 for solenoid assembly 24. The injection molding process completely encloses and seals solenoid assembly 24 while simultaneously forming a plug-in receptacle 74 enclosing terminal blades, a mounting flange 76 for filter cover 28, and a lower connecting flange 78 for mating with upper valve housing 26.

The lower connecting flange 78 of housing 72 for solenoid assembly 24 is shown retained and sealed within an external cavity 80 formed in upper valve housing 26. Moreover, the circular-shaped cavity defined by the inner diameter of lower connecting flange 78 of solenoid housing 72 defines an EVR chamber 82 below armature 46 that selectively communicates with air inlet 38 via central bore 36. A nonmagnetic cup-shaped member 84 is disposed within EVR chamber 82 for supporting armature 46 in an "open" valve position (FIG. 1) displaced from valve seat member 48. The inside diameter of EVR chamber 82 is slightly greater than the diameter of armature 46 to permit axial movement yet confine lateral movement of armature 46 therein. To facilitate air flow around the periphery of armature 46 when it is displaced from sealed engagement (i.e., the "closed" valve position) with valve seat member 48, armature 46 has a plurality of radially-spaced notches 86, (FIG. 2) formed along its peripheral edge, and cup member 84 has a plurality of slots 88 formed therein for providing a communication pathway between pole piece central bore 36 and EVR chamber 82.

According to one advantageous feature of the present invention, EVR valve 12 is not equipped with a preloaded armature spring that is commonly used in conventional flow regulators for urging armature 46 toward a "closed" valve position. Thus, the inherent preload variations associated with production spring components is eliminated. In addition, the sensitive calibration associated with adjusting the preload exerted by such an armature bias spring and/or the cumbersome requirements of changing such springs to match calibration requirements is no longer required.

With continued reference to FIG. 1, vacuum regulator valve 14 is shown as a vacuum-operable diaphragm valve having a control chamber 90 formed within upper housing 26 and above a movable diaphragm valve assembly 92, and a valve chamber 94 formed within a lower housing 96 below diaphragm valve assembly 92. In addition, a vacuum inlet, shown as nippled connector 98, is formed in upper housing 26 and has a passage 100 which communicates with control chamber 90 through a flow-restrictive orifice 102. Nippled connector 98 is adapted for connection via suitable tubing (not shown) to a vacuum signal source, namely manifold vacuum for the intake manifold of the engine, identified by block 104. Moreover, control chamber 90 communicates with EVR chamber 82 via an orifice 105 formed in the bottom of external cavity 80 such that the vacuum signal (negative pressure) delivered to control chamber 90 from EVR valve 12 is a controlled portion of the vacuum input at connector 98 as determined by the electrical control signal supplied by ECU 22 to windings 32 of solenoid assembly 24. Alternatively, it is contemplated that the vacuum inlet could be positioned to communicate directly with EVR chamber 82.

According to yet another feature of the present invention, control chamber 90 is preferably divided into two distinct portions, namely an attenuation or "damping" chamber 106 and a reference chamber 108 by a damping ring 110. In general, damping chamber 106 is located intermediate to EVR chamber 82 and reference chamber 108 and is operable for attenuating fluctuations in the vacuum signal supplied to reference chamber 108 and diaphragm valve assembly 92 upon actuation of EVR valve 12. More particularly, damping ring 110 is an annular member that is retained between an outer wall portion 114 and an inner wall portion 116 of upper housing 26 for segregating damping chamber 106 from reference chamber 108. Damping chamber 106 is located above damping ring 110 while reference chamber 108 is located below damping ring 110 and includes a central cavity 118 defined by circular inner wall portion 116 so as to act over the entire top surface of diaphragm valve assembly 92. One or more damping orifices 120 are formed in damping ring 110 to attenuate fluctuations in the vacuum signal supplied to vacuum regulator valve 14 upon actuation of EVR valve 12 which, in turn, inhibits undesirable oscillation (i.e., "flutter") of diaphragm valve assembly 92. More specifically, since ECU 22 supplies a sawtooth waveform, preferably at about 100 Hz, to drive solenoid assembly 24 of EVR valve 12, direct application of the vacuum signal in EVR chamber 82 to diaphragm valve assembly 92 in control chamber 90 may cause valve assembly 92 to oscillate. Thus, it is desirable to isolate diaphragm valve assembly 92 from the 100 Hz vacuum fluctuation by providing damping chamber 106 with a larger volume than EVR chamber 82 for effectively reducing the magnitude of any pressure fluctuations. In addition, damping orifice 120 is sized to provide the amount of restrictive flow necessary to balance the vacuum pressure between damping chamber 106 and reference chamber 108 such that a balanced vacuum is established in control chamber 90 that matches the vacuum signal in EVR chamber 82.

To provide means for regulating the purge flow of fuel vapors from canister 18 to the engine's intake system 20, lower housing 96 of vacuum regulator valve 14 includes a nippled inlet connector 128 adapted for connecting inlet passageway 130 to canister 18 via suitable tubing (not shown) and a nippled outlet connector 132 adapted for connecting outlet passageway 134 to intake manifold 20 of the engine. Vacuum-actuated diaphragm valve assembly 92 is comprised of a rigid piston 136 and a flexible diaphragm 138 that are retained between valve housings 26 and 96 for controlled axial movement to regulate the purge flow from canister 18 and inlet passageway 130 to outlet passageway 134 and the engine's intake manifold 20. In addition, inlet passageway 130 communicates with valve chamber 94 via inlet orifice 140. Valve chamber 94 is adapted to selectively communicate with outlet passageway 134 via an exit tube 142 in response to the axial movement of a poppet-type closure member 146 in a direction away from an annular valve seat 148 formed at one end of exit tube 142.

As best seen from FIG. 1, poppet-type closure member 146 is integrally associated with an underside portion of diaphragm valve assembly 92, while the upper side of diaphragm valve assembly 92 includes a first spring retainer 150 that is preferably integral with piston 136. A calibration screw 152 is threaded into a threaded aperture 154 formed in a central boss 156 of upper valve housing 26 and which supports a second spring retainer 158 thereon. A helical coil spring 160 is centrally disposed within reference chamber 108 of control chamber 90 and is retained between the aligned spring retainers 150 and 158 for, exerting a biasing force on diaphragm valve assembly 92 such that poppet-type closure member 146 is normally biased against valve seat 148 for inhibiting flow through vacuum regulator valve 14. As will be discussed in greater detail, the "preload" or biasing force exerted by coil spring 160 on diaphragm valve assembly 92 can be selectively calibrated by adjusting the threaded position of calibration screw 152.

When the engine of the vehicle equipped with vapor management valve 10 is not in operation, EVR valve 12 is not energized (i.e., 0% duty cycle) such that armature 46 is urged by gravity and atmospheric air to the "open" valve position displaced from seated engagement with valve seat member 48 for engagement with an upper planar surface of cup member 84. Moreover, in the absence of manifold vacuum 104 being applied to control chamber 90 via passage 100 and flow-restrictive orifice 102, the preload on coil spring 160 urges diaphragm valve assembly 92 downwardly to cause closure member 146 to seat against valve seat 148. In this condition, flow of fuel vapors from valve chamber 94 to outlet port 142 is inhibited. However, when the vehicle is in operation, a negative vacuum pressure is introduced into control chamber 90 through vacuum inlet passage 100 and flow-restrictive orifice 102, thereby tending to maintain armature 46 in the "open" valve position. Concurrently, filtered air flow is drawn into air inlet 38 and enters EVR chamber 82 for generating a controlling vacuum signal within control chamber 90 which is a controlled portion of the manifold vacuum 104 supplied at inlet passage 100. As is known, energization of solenoid assembly 24 of EVR valve 12 in response to the control signal supplied by engine control unit ("ECU") 22 is operable for exerting a magnetic attractive force between armature 46 and pole piece 34 in opposition to the effect of the vacuum pressure from manifold vacuum 104. Thus, the amount of vacuum, and hence the "vacuum signal" provided to control chamber 90 of vacuum regulator valve 14 is controlled by the degree to which armature 46 is attracted toward valve seat 42. In particular, the magnitude of the magnetic attractive force exerted on armature 46 is equal to the product of the vacuum pressure in EVR chamber 82 multiplied by the cross-sectional area of armature 46. In addition, the flow restriction from air inlet 38 to EVR chamber 82 results in a pressure drop proportional to the magnetic force applied to armature 46. Therefore, as the magnetic attraction force exerted on armature 46 increases, the level of vacuum pressure in EVR chamber 82 also increases. Similarly, as the magnetic attraction force exerted on armature 46 decreases, the level of vacuum pressure in EVR chamber 82 also decreases. Thus, the percentage duty cycle of the electrical control signal supplied to EVR valve 12 from ECU 22 controls the "vacuum signal" provided to the reference side of vacuum regulator valve 14.

Vacuum regulator valve 14 is shown to include a diffuser ring 162 which segregates valve chamber 94 into a lower prechamber 164 communicating with inlet passageway 130 via inlet orifice 140, and an upper chamber 166 that is located above diffuser ring 162 and which communicates with exit tube 142. In addition, diffuser ring 162 has a series of equally-spaced radial orifices 168 for permitting communication between prechamber 164 and upper chamber 166. As is known, flow through any single orifice is inherently turbulent, which tends to generate flow noise (pressure fluctuations). Such flow noise can also cause undesirable oscillatory movement of diaphragm valve assembly 92 which, in turn, can result in output flow fluctuations. Thus, placement of diffuser ring 162 between inlet orifice 140 and diaphragm valve assembly 92 reduces the potential for any such fluctuations. It is contemplated that the number, spacing and size of orifices 168 in diffuser ring 162 can be selected to provide optimized performance characteristics. Alternatively, diffuser ring 162 could be replaced with a laminar flow restriction, such as a sintered metal filter element.

Figure 3:
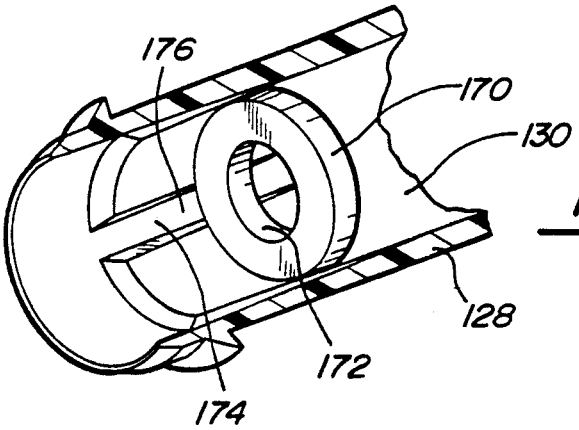
FIG. 3 is a partially-sectioned perspective view of an adjustable orifice arrangement for the diaphragm-type vacuum regulator valve of the flow regulator.
Figure 4:
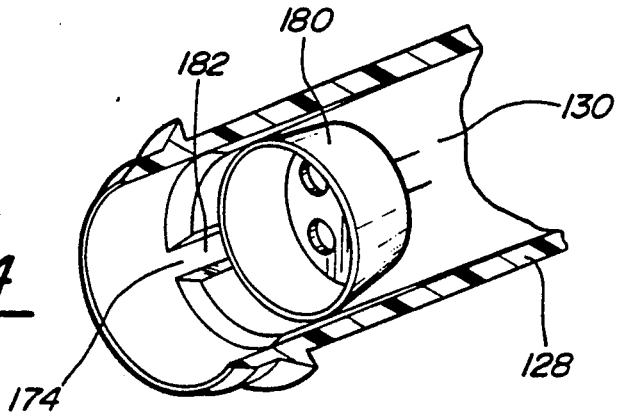
FIG. 4 is a partially-sectioned perspective view of an alternative adjustable flow-restrictive arrangement for the vacuum regulator valve.

Since it is desirable to precisely adjust the output flow of vapor management valve 10 at a 100% duty cycle signal, calibration means are provided for varying the inlet flow from canister 18 into inlet passageway 130. According to one embodiment, the calibration means is adapted to effect only a portion of the flow through inlet passageway 130, thereby substantially minimizing the sensitivity of such adjustments. In particular, FIGS. 1 and 3 illustrate use of an orifice ring 170 having a central orifice 172 formed therein. A plurality of tapered channels 174 are formed in the inner wall surface of inlet connector 128. Upon insertion of orifice ring 170 into inlet connector 128, the flow openings 176 formed between the outer peripheral outer edge of orifice ring 170 and tapered channels 174 define a parallel flow path in conjunction with flow through central orifice 172. Due to the tapered profile of channels 174, the area of flow openings 176 varies with respect to the axial position of orifice ring 170, whereby the amount of flow through the parallel flow path can be variably adjusted. Alternatively, FIG. 4 illustrates means for adjusting the inlet flow by providing a restrictor plug 180 in place of orifice ring 170 such that longitudinal adjustment of restrictor plug 180 relative to tapered channels 174 results in a corresponding adjustment in the level of flow restriction associated with flow openings 182. With either arrangement, it is preferable that the pressure differential between full canister pressure and valve chamber 94 be distributed with about approximately 30–70% generated by flow through the adjustable flow openings and the remainder generated by flow through inlet orifice 40 and the plurality of orifices 168 in diffuser ring 162.

Figure 5:
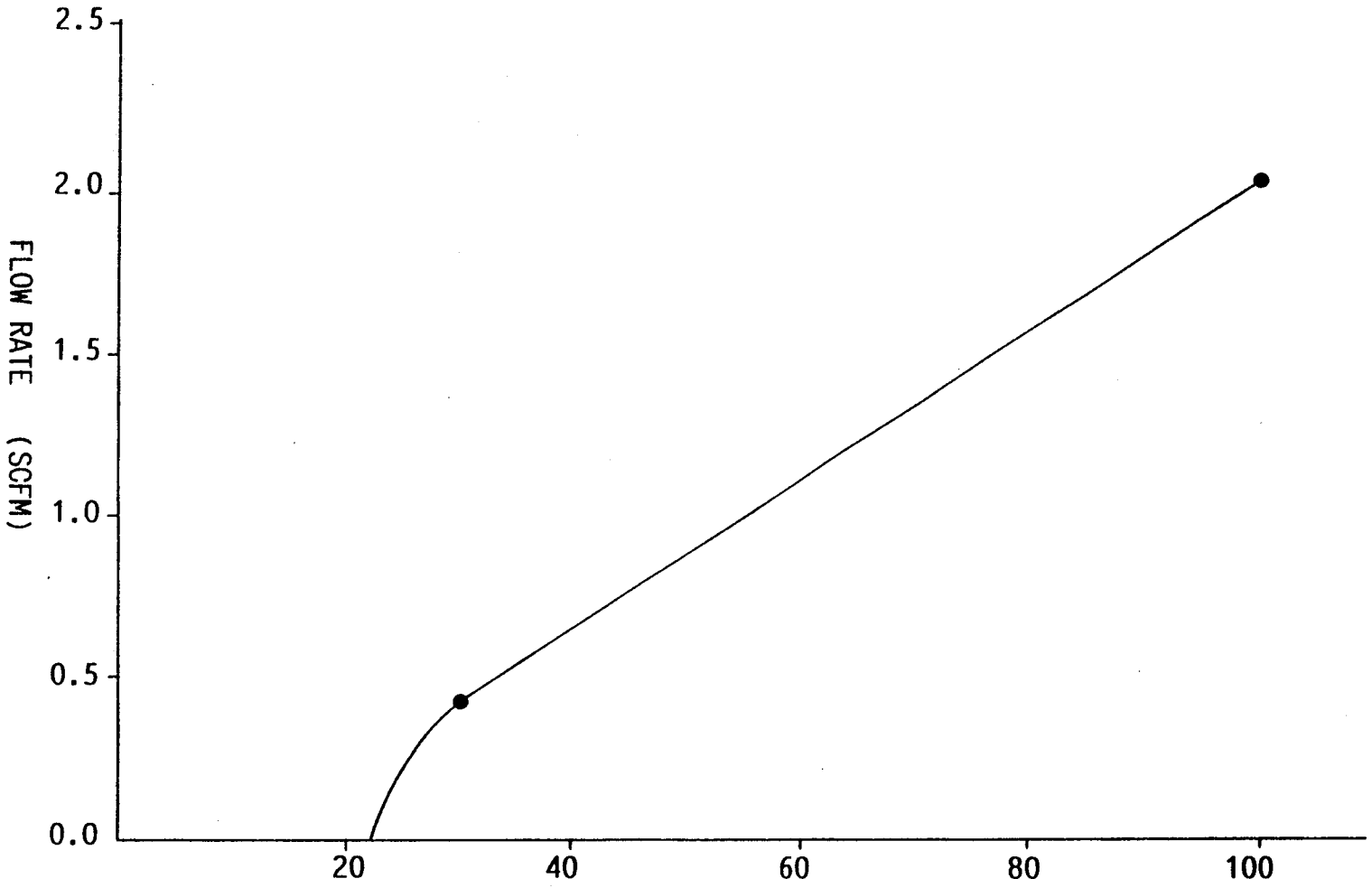
FIG. 5 is an exemplary plot which graphically illustrates the substantially linear output flow rate of the flow regulator as a function of percentage duty cycle for the input control signal.

Preferably, vapor management valve 10 is operable for varying the output or purge flow through vacuum regulator valve 14 in a substantially linear manner from a predetermined "start-to-flow" duty cycle to a 100% duty cycle. More particularly, vapor management valve 10 functions to provide a flow rate that is linearly proportional to the percentage duty cycle of the electrical control signal supplied to terminal 33 of solenoid assembly 24 from ECU 22. In addition, with the duty cycle held constant, the flow rate is also held substantially constant regardless of variations in the magnitude of manifold vacuum 104 within a predetermined range of operating limits (i.e., about 125 mm $H_g$ to 405 mm $H_g$). This linear function between the two calibration points is referred to as the "regulated" portion of the performance curve. Such a relationship can be seen in reference to the exemplary performance curve shown in FIG. 5. More preferably, valve assembly 92 inhibits purge flow, that is, it remains closed below about a 20% duty cycle signal. However, since it has been determined that output flow is relatively non-linear below about a 30% duty cycle signal, the "start-to-flow" is set at that point. As such, the armature biasing spring used in conventional EVR valves can be eliminated since the magnetic fluid generated below the 30% duty cycle is strong enough to lift armature 46 to seat against valve seat member 48.

In an effort to promote stable operation of vacuum regulator valve 14, three distinct pressures which act over three different areas must balance the preload exerted by coil spring 160 on diaphragm valve assembly 92. More particularly, the three distinct pressures include the pressure in reference chamber 108 acting over the entire effective area of diaphragm valve assembly 92; the pressure in exit tube 142 acting over the effective area of closure member 146; and the pressure in valve chamber 94 acting on the effective area of diaphragm valve assembly 92 minus the effective area of closure member 146. As is apparent, the effective area of poppet-type closure member 146 changes with movement of diaphragm valve assembly 92. In particular, the effective area is equal to the area of valve seat 148 when closure member 146 is nearly closed and gradually becomes smaller, approaching zero, as closure member 146 moves away from valve seat 148. Since the pressure in exit tube 142 is lower than the pressure in valve chamber 94, there is a tendency to pull closure member 146 toward valve seat 148. With vapor management valve 10 operating in a equilibrium condition, movement of diaphragm valve assembly 92 away from valve seat 148 causes the closing force exerted on closure member 146 to diminish. As such, the flow out of exit tube 142 results in a pressure drop in valve chamber 94 which, in turn, results in a restoring force which tends to return closure member 146 to its original equilibrium position. Accordingly, to inhibit the restoring force associated with pressure changes in valve chamber 94 from "lagging" the disturbing force associated with the pressure in exit tube 142 acting on the effective area of closure member 146, valve chamber 94 can be optionally sized to stabilize the system. More particularly, if the volume of valve chamber 94 is relatively small, then the pressure change generated in response to movement of the diaphragm valve assembly 92 will be relatively large. Preferably, vacuum regulator valve 14 is constructed such that the force change due to a pressure drop in valve chamber 94 is several times greater than the force change associated with changes in the effective area of closure member 146 relative to valve seat 148.

When vapor management valve 10 is operating in the regulated portion of the performance curve, a vacuum signal, is delivered to reference chamber 108. When the negative vacuum pressure in reference chamber 108 exceed a certain magnitude, the preloaded bias of coil spring 160 is overcome and diaphragm valve assembly 92 is displaced from valve seat 148 to permit a specified flow rate of fuel vapors from canister 18 to be delivered to intake manifold 20 which, in turn, causes a concurrent increase in the vacuum pressure in valve chamber 94. Thus, in a steady state condition at a given duty cycle, a regulated equilibrium condition is established between reference chamber 108 and valve chamber 94 to maintain the specified flow rate. However, if the magnitude of the manifold vacuum changes while the duty cycle is held constant, diaphragm valve assembly 92 will move until a new regulated equilibrium condition is established. Moreover, the new equilibrium relationship established between reference chamber 108 and valve chamber 94 causes a concurrent adjustment in the flow restriction between closure member 146 and valve seat 148 such that the purge flow from canister 18 is maintained at the prior specified flow rate. Thus, the purge flow characteristics for any specific duty cycle within the regulated limits of the performance curve are maintained substantially constant in a manner that is independent of changes in the manifold vacuum.

Vapor management valve 10 also functions to linearly adjust the flow rate in proportion to changes in the percentage duty cycle of the control signal applied to coil windings 36 of solenoid assembly 24. More particularly, a controlled change in the duty cycle signal, within the regulated limits, causes a proportional change in the vacuum signal supplied to control chamber 90 which, in turn, moves diaphragm valve assembly 92 until a new equilibrium condition is established. Accordingly, such a change in duty cycle causes a linearly proportional change in the flow rate from canister 18 to intake manifold 22. Again, such a controlled change in flow rate can be thereafter maintained independent of fluctuations in manifold vacuum 104.

Once assembled, vapor management valve 10 is ready to be calibrated. As noted, a primary advantage of the present invention over conventional flow regulator devices is that sensitive calibration of EVR valve 12 is not required, thereby permitting "net-build" non-calibrated EVR valves to be used. In general, all calibration requirements for vapor management valve 10 are accomplished by making simple and highly accurate calibration adjustments to vacuum regulator valve 14. In order to calibrate the device, terminal blades 33 are connected to an electrical current source, vacuum inlet connector 98 is connected to a source of vacuum, and outlet connector 132 is connected to a flowmeter or other suitable monitoring device. A current signal having a 30% duty cycle is applied to terminal blades 33 and a predetermined negative vacuum pressure is applied through passageway 100 and restrictive orifice 102 into control chamber 90. Calibration screw 152 is then rotated as appropriate (preferably backed-out of threaded aperture 154) to vary the preload exerted by coil spring 160 on diaphragm valve assembly 92 until the flowmeter registers a desired "start-of-flow" flow rate. Thereafter, a predetermined current signal corresponding to a 100% duty cycle signal is applied to terminal blades 33, the flow through outlet connector 132 is monitored and the size of parallel flow openings 176 or of flow restrictive openings 182 in inlet passageway 130 is varied by adjusting the axial position of orifice ring 170 or plug 180, respectively, relative to tapered channels 174 for setting the maximum flow rate calibration point. Since such flow opening size adjustments are on the opposite side of diaphragm valve assembly 92 to that of the preload adjustment for coil spring 160, each separate calibration adjustment does not affect the other, whereby each is independent and non-cumulative in nature. In this manner, the calibration points for the beginning and end of the regulated portion of a performance curve can be established for defining the linear flow characteristic of vapor management valve 10.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A flow regulator for controlling the purging of fuel vapors collected in a canister of an evaporative emission control system into an intake system of an internal combustion engine, comprising:

a first valve having a vacuum inlet in communication with a vacuum source of the intake system and means for generating a vacuum signal that is a controlled portion of the vacuum received at said vacuum inlet in response to an electrical control signal; and a second valve having a first chamber in communication with said vacuum signal, a second chamber, a diaphragm valve retained for movement between said first and second chambers, inlet means connecting the canister for communication with said second chamber, outlet means communicating with the engine intake system, closure means for controlling flow between said inlet means and said outlet means in response to movement of said diaphragm valve, biasing means acting on said diaphragm valve for inhibiting flow between said inlet means and said outlet means, first calibration means for varying the biasing force exerted by said biasing means on said diaphragm valve for setting a first flow rate limit, and second calibration means for varying the flow in said inlet means to set a second flow rate limit, said flow regulator operable to generate substantially linear flow between said first and second flow rate limits as a function of the value of said control signal and independent of variations in the magnitude of the vacuum supplied to said vacuum inlet by said vacuum source.

2. The flow regulator of claim 1 wherein said first valve is an electric vacuum regulator valve and said means for generating said vacuum signal includes an electromagnetic solenoid assembly having a passageway communicating with atmosphere, an EVR chamber communicating with said vacuum inlet, a magnetic flux path including a magnetic armature member, and means for establishing the flow of electromagnetic flux through said flux path, said magnetic armature being movable for controlling flow through said passageway in response to the magnitude of said electric control signal supplied to said means for establishing flow of electromagnetic flux.

3. The flow regulator of claim 2 wherein said vacuum inlet is formed between said EVR chamber and said first chamber of said second valve with said second valve having a passageway providing direct communication between said vacuum source and said first chamber.

4. The flow regulator of claim 1 wherein said biasing means is a coil spring retained within said first chamber and said first calibration means is operable for varying the preload on said coil spring which must be overcome to permit said diaphragm valve to move to a position whereat said closure means is displaced from said outlet means to permit flow of fuel vapors from said inlet means to said outlet means.

5. The flow regulator of claim 4 wherein said first calibration means is a calibration screw that is fixedly connected to a spring retainer acting on said coil spring, said calibration screw being threaded into a threaded aperture formed in a housing portion of said second valve such that rotation of said calibration screw causes axial displacement of said spring retainer for adjusting the level of preload exerted on said coil spring.

6. The flow regulator of claim 1 wherein said second calibration means comprises means for establishing an adjustable parallel flow path within said inlet means.

7. The flow regulator of claim 6 wherein said means for establishing an adjustable parallel flow path includes a series of tapered channels formed in said inlet means and a ring member having a central orifice formed therein, wherein flow openings are formed between an outer peripheral edge of said ring member and said tapered channels which are parallel to said central orifice, and wherein adjustment of the position of said ring member relative to said tapered channels is operable for adjustably varying the area of said flow openings.

8. The flow regulator of claim 1 wherein said second calibration means comprises an adjustable flow restriction means located with said inlet means.

9. The flow regulator of claim 8 wherein said adjustable flow restriction means includes a series of tapered channels formed in said inlet means and a plug member such that adjustment of said plug member relative to said tapered channels causes a corresponding change in the area of flow restrictive opening formed therebetween.

10. The flow regulator of claim 1 wherein said second valve further comprises means for segregating said first chamber into a damping chamber and a reference chamber, said damping chamber communicating directly with said vacuum inlet and said reference chamber communicating directly with said diaphragm valve, said segregating means having orifice means for permitting communication between said damping chamber and said reference chamber for attenuating fluctuations in said vacuum signal delivered to said diaphragm valve.

11. The flow regulator of claim 1 wherein said second valve further comprises a diffuser ring disposed in close proximity to said diaphragm to minimize the volume of said second chamber, said diffuser ring having a series of diffusing orifices formed therein for distributing flow from said inlet means to said diaphragm valve.

12. A flow regulator for controlling the purging of fuel vapors collected in a canister of an evaporative emission control system into an intake system of an internal combustion engine, comprising:

a first valve having a vacuum inlet connected to a vacuum source, a first chamber in communication with said vacuum inlet, a second chamber, a pressure-operable diaphragm valve retained for movement between said first and second chambers, inlet means connecting the canister for communication with said second chamber, outlet means communicating with the engine intake system such that movement of said diaphragm valve is operable for controlling flow between said inlet means and said outlet means, biasing means acting on said diaphragm valve for biasing said diaphragm valve to inhibit flow between said inlet means and said outlet means, first calibration means for varying the biasing force exerted by said biasing means on said diaphragm valve for setting a first flow rate value, and second calibration means for varying the flow in said inlet means to set a second flow rate value; and a second valve in communication with said first chamber of said first valve and having electrically-controllable means for generating a vacuum signal as a percentage of the vacuum pressure received at said vacuum inlet in response to an electrical control signal, said vacuum signal being controllably regulated for generating substantially linear flow between said first and second flow rate values as a function of the magnitude of said electrical control signal and independent of variations in said vacuum pressure supplied to said vacuum inlet by said vacuum source.

13. The flow regulator of claim 12 wherein said second valve is an electric vacuum regulator and said electrically controllable means comprises an electromagnetic solenoid assembly having a passageway communicating with atmosphere, an EVR chamber communicating with said first chamber of said first valve, a magnetic flux path including a magnetic armature member, and means for establishing the flow of electromagnetic flux through said flux path, said magnetic armature being movable for controlling flow through said passageway in response to the magnitude of said electric control signal supplied to said means for establishing flow of electromagnetic flux.

14. The flow regulator of claim 12 wherein said biasing means is a coil spring retained within said first chamber and said first calibration means is operable for varying the preload on said coil spring which must be overcome to permit said diaphragm valve to move to a position displaced from said outlet means for permitting flow of fuel vapors from said inlet means to said outlet means.

15. The flow regulator of claim 14 wherein said first calibration means is a calibration screw that is in contact with a spring retainer acting on said coil spring, said calibration screw being threaded into a threaded aperture formed in a housing portion of said second valve such that rotation of said calibration screw causes axial displacement of said spring retainer for adjusting the level of preload exerted on said coil spring.

16. The flow regulator of claim 12 wherein said second calibration means comprises means for establishing an adjustable flow path within said inlet means.

17. The flow regulator of claim 16 wherein said means for establishing an adjustable flow path includes a series of tapered channels formed in said inlet means and a ring member having a central orifice formed therein, wherein flow openings are formed between an outer peripheral edge of said ring member and said tapered channels which are parallel to said central orifice, and wherein adjustment of the position of said ring member relative to said tapered channels is operable for adjustably varying the area of said flow openings.

18. The flow regulator of claim 16 wherein said means for establishing an adjustable flow path includes a series of tapered channels formed in said inlet means and a plug member such that adjustment of said plug member relative to said tapered channels causes a corresponding change in the area of flow restrictive opening formed therebetween.

19. An evaporative emission control system for collecting fuel vapors vented from the vehicle's fuel tank and purging the fuel vapors into the intake system for combustion in the internal combustion engine, comprising:

a canister in communication with the fuel system for collecting the fuel vapors therein; and a vapor management valve for controlling the purging of fuel vapors from said canister into the intake system in response to an electrical control signal, said vapor management valve comprising:

a vacuum regulator having a vacuum inlet connected to engine manifold vacuum, a first chamber in communication with said vacuum inlet, a second chamber, a pressure-operable diaphragm valve retained for movement between said first and second chambers, inlet means connecting said canister for communication with said second chamber, outlet means communicating with the intake system such that movement of said diaphragm valve is operable for controlling flow between said inlet means and said outlet means, biasing means acting on said diaphragm valve for biasing said diaphragm valve to inhibit flow between said inlet means and said outlet means, first calibration means for varying the biasing force exerted by said biasing means on said diaphragm valve for setting a first flow rate value, and second calibration means for varying the flow in said inlet means too set a second flow rate value; and an electric regulator in communication with said first chamber of said first valve and having electrically controllable means for generating a vacuum signal as a percentage of engine manifold vacuum received at said vacuum inlet in response to said electrical control signal, said vacuum signal being controllably regulated for generating substantially linear flow between said first and second flow rate values as a function of the magnitude of said electrical control signal and independent of variations in engine manifold vacuum.

20. The control system of claim 19 wherein said electrically-controllable means comprises an electromagnetic solenoid assembly having a passageway communicating with atmosphere, an EVR chamber communicating with said first chamber of said first valve, a magnetic flux path including a magnetic armature member, and means for establishing the flow of electromagnetic flux through said flux path, said magnetic armature being movable for controlling flow through said passageway in response to the magnitude of said electric control signal supplied to said means for establishing flow of electromagnetic flux.

21. The control system of claim 19 wherein said biasing means is a coil spring retained within said first chamber and said first calibration means is operable for varying the preload on said coil spring which must be overcome to permit said diaphragm valve to move to a position displaced from said outlet means for permitting flow of fuel vapors from said inlet means to said outlet means.

22. The control system of claim 21 wherein said first calibration means is a calibration screw that is fixedly connected to a spring retainer acting on said coil spring, said calibration screw being threaded into a threaded aperture formed in a housing portion of said second valve such that rotation of said calibration screw causes axial displacement of said spring retainer for adjusting the level of preload exerted on said coil spring.

23. The control system of claim 19 wherein said second calibration means comprises means for establishing an adjustable flow path within said inlet means.

24. The control system of claim 23 wherein said means for establishing an adjustable flow path includes a series of tapered channels formed in said inlet means and a ring member having a central orifice formed therein, wherein flow openings are formed between an outer peripheral edge of said ring member and said tapered channels which are parallel to said central orifice, and wherein adjustment of the position of said ring member relative to said tapered channels is operable for adjustably varying the area of said flow openings.

25. The control system of claim 23 wherein said means for establishing an adjustable flow path includes a series of tapered channels formed in said inlet means and a plug member such that adjustment of said plug member relative to said tapered channels causes a corresponding change in the area of flow restrictive opening formed therebetween.

* * * * *

UNITED STATES PATENT AND TRADEMARK OFFICE

CERTIFICATE OF CORRECTION

PATENT NO. : 5,277,167

DATED : January 11, 1994

INVENTOR(S) : Daniel L. DeLand et al.

It is certified that error appears in the above-identified patent and that said Letters Patent is hereby corrected as shown below:

Column 14, line 31, claim 19, "too" should be --to--.

Column 14, line 33, claim 19, after "electric", insert --vacuum--.

Signed and Sealed this

Twelfth Day of July, 1994

Bruce Lehman

*Attest:*

BRUCE LEHMAN

*Attesting Officer*

*Commissioner of Patents and Trademarks*